US006082733A

United States Patent [19]

Borel

[11] Patent Number: 6,082,733

[45] Date of Patent: Jul. 4, 2000

[54] SORTING DEVICE IN A CONVEYOR OF PLATE-LIKE WORKPIECES

[75] Inventor: Edouard Borel, Corcelles-Chavornay, Switzerland

[73] Assignee: Bobst S.A., Lausanne, Switzerland

[21] Appl. No.: 09/092,414

[22] Filed: Jun. 4, 1998

[30] Foreign Application Priority Data

Jun. 12, 1997 [CH] Switzerland ..... 1432/97

[51] Int. Cl.[7] ..... B65H 39/10

[52] U.S. Cl. ..... 271/303; 271/200; 271/202

[58] Field of Search ..... 271/303, 305, 271/200, 184, 202

[56] References Cited

U.S. PATENT DOCUMENTS

| | | | |
|---|---|---|---|
| 3,417,989 | 12/1968 | Haselow . | |
| 3,729,188 | 4/1973 | Stephenson | 271/303 |
| 4,245,833 | 1/1981 | Akerstrom | 271/303 |
| 4,324,522 | 4/1982 | Buccicone . | |
| 4,426,074 | 1/1984 | Fischer . | |
| 5,279,195 | 1/1994 | Breton . | |
| 5,472,185 | 12/1995 | Kollann et al. | 271/303 |

FOREIGN PATENT DOCUMENTS

| | | | |
|---|---|---|---|
| 0733448 A1 | 9/1966 | European Pat. Off. . | |
| 0 045713 | 11/1984 | European Pat. Off. . | |
| 2470747 | 6/1981 | France | 271/200 |
| 2688493 | 9/1993 | France . | |
| 1223682 | 8/1966 | Germany . | |
| 0147762 | 6/1988 | Japan | 271/303 |

*Primary Examiner*—H. Skaggs
*Attorney, Agent, or Firm*—Allen N. Friedman; McCarter & English LLP

[57] ABSTRACT

The disclosed sorting device, within a conveyor of plate-like workpieces, comprises a first lower rear conveyor (40) ending in a front wheel or roller (42) driven in rotation. It also comprises a second lower front conveyor (50) located behind the first and beginning with a rear wheel or roller (52) driven in rotation. It is also provided with compression device (30, 35) for pressing the plate-like workpieces against the lower conveyors, and a sorter (60) interposed between the front roller (42) of the first conveyor (40) and the rear roller (52) of the second conveyor (50), the sorter (60) having, in cross section, a corner facing the upstream or feed end of the conveyor, with a first side parallel to the normal path of the conveyors, and a second slanted side along an ejection path passing between the first and second lower conveyors. The device also comprises deflection means (26, 32) situated slightly above the front half of the front wheel or roller (42) of the first conveyor (40).

9 Claims, 4 Drawing Sheets

SORTING DEVICE IN A CONVEYOR OF PLATE-LIKE WORKPIECES

RELATED APPLICATION

This application claims priority of Switzerland Application No. 1997 1432/97, filed Jun. 12, 1997 FEDERALLY SPONSORED RESEARCH: Not Applicable

BACKGROUND OF THE INVENTION

1. Field of the Invention.

The present invention relates to a sorting device in a conveyor of plate-like workpieces, and more particularly to a sorting device within a belt conveyor situated between the output of a machine for processing successive sheets of paper or cardboard panel, and a piling station. The sorting device ejects defective sheets or panels toward a delivery area.

2. Brief Description of the Background Art.

The processing machines considered here may be machines for die-cutting blanks and /or printing of on, or more colors or metalized patterns onto the blanks and/or folding blanks into flat boxes. The potential faults requiring rejection of blanks may be, for example, color registration errors, glue stains, or inaccurate folding. These faults are detected by automatic quality control devices, based upon the scanning of photocells arranged in the travelling plane of the workpieces. The workpieces detected as being faulty are taken out of the stream of workpieces by sorting devices, also called ejectors, before the workpieces are piled into delivery batches.

A known rotating ejector rotates about a vertical axis, pivoting the sheet to be ejected between the belts of the conveyor. However, the conveyor speed and the maximum size of the sheets that can be ejected, are limited. Moreover, the rotational motion imparted to the ejected sheet may interfere with the flow of the accurate sheets, or even cause a jam.

A Linear ejector moving the ejected sheets at an angle of 45° or 60° to the normal stream is also known. This ejector has the advantage of not interfering with the flow of accurate sheets. However, the minimum and maximum sizes of the sheets that can be handled by this device are also limited. Also, these ejectors require accurate adjustment of the sheet thickness and are comparatively difficult to use.

Moreover, these two ejector types each require one of the conveyor belts to be raised in order to ensure an appropriate ejection. This makes the transport of the other sheets more uncertain. In addition, the ejection at high speed may be hazardous to people near the machine.

The document EP 045 713 describes a sorting device for flat folded cardboard boxes, based on mounting a lower intermediate part of the belt conveyor in a frame that is tiltable by means of a pneumatic cylinder. The frame rotates around the axis of the conveyor's rear end roller in such a way that its lowered front end roller opens an ejecting path in the downward direction for (defective boxes detected by a photocell.

U.S. Pat. No. 4,324,522 discloses a device of the same type provided for sorting metallic plates into different stacks, in which the selecting part of a tilting conveyor is the front end of a long feed conveyor. The rear end of the following conveyor may include a deflection plate which simultaneously raises with the lowering of the adjacent selecting part in order to complete the descent of the plates to be ejected.

However, this type of sorting equipment, first, uses large and heavy elements involving significant inertias, requiring powerful and hence costly drive means. Moreover, this type of sorting equipment occupies a significant volume within the machine. In addition, in the second, embodiment, a mechanism for keeping the tension in the belts of the first feed conveyor as the front end tilts should be provided.

Most important, in each of the aforementioned devices, the ejected plate-like workpieces, such cardboard boxes, are not always adequately controlled i.e. they are not held or driven along, their deflection and ejection paths. This fact may lead to situations of selective accumulation, o(r even jam, requiring machine stoppage.

The document F# 2 688 493 discloses a device for cutting out and deflecting a faulty part of a continuously processed web. This device comprises a slanted deflection plate oriented in the forward and downward direction between the vertical pairs of drive shafts of the web in normal horizontal travel. The upper edge of the plate which is located just underneath the normal path forms an anvil. A lower flap with a separation blade that is normally in raised position guides the web above the plate. When a defective web part is detected, the lower flap lowers and an upper separation flap with a blade edge rotates down against the anvil in order to cut the web and to direct it along the plate toward the ejection path, where the defective web is pulled by traction roller. At the arrival of a new adequate web part, the upper separating flap raises and the lower flap strikes the anvil so as to again cut the web and to direct the new front edge of the web in the direction of the normal travel path.

However, this processing device for a continuous web is ill-suited and too complex, hence too costly for processing successive plate-like workpieces that do not have to be cut and that preferably, must be almost continually driven by a belt conveyor or a conveyor with closely spaced parallel rollers.

SUMMARY OF THE INVENTION

The aim of the present invention is a particularly reliable sorting device within a conveyor of plate-like workpieces, i.e. one that is able to unambiguously change the direction of a selected workpiece so as to make impossible for the latter to collide with a mechanical element of the conveyor. If required, the device must be able to bend a workpiece, even if it is heavy, when directing it toward the new direction.

This device must at a minimum reduce the risks of jam, particularly by compensating for reduced separation of the workpieces in such a way that the workpieces remain as much as possible under the control of the forwarding drive elements, whether directed towards the normal path or toward the ejection path.

In addition, this device has to be particularly dynamic, i.e. having a very rapid tilting time, in order to operate at high production rates. Preferably, the number of movable sorting elements should be as few as possible and should each have a low mass and/or inertia. Preferably, the operation of this device should also consume relatively little mechanical power.

Finally, it is desirable that this sorting device occupy as little space as possible, in order to leave enough space for a salvage container, for drive means in the ejection path, and for accessing the elements for maintenance or repair.

These aims are achieved by a sorting device within a conveyor of plate-like workpieces comprising, in combination:

a first lower rear conveyor ending in a front wheel or roller driven in rotation;

a second lower front conveyor behind the first and beginning with a rear wheel or roller driven in rotation;

a pressure means for pressing the plate-like workpieces against the lower conveyors;

a sorting means, interposed between the front wheel or roller of the first conveyor and the rear wheel or roller of the second conveyor, this means having in cross section, a rear facing corner with a first side aligned with the normal path but located slightly below that path, and a second slanted side aligned with an ejection path between the first and second lower conveyors; and a deflection means disposed slightly above the front half of the front wheel or roller of the first conveyor, which, in raised position, does not interfere with the normal path of the workpieces along the first side of the sorting means, and which in lowered position, forces the workpieces to follow a path that is bent against the front surface of the front wheel or roller such that the ejection path continues under the slanted side of the sorting means.

The terms "front" and "rear" define a direction with respect to the travelling direction of the workpieces, i.e. respectively in the downstream direction and in the upstream workpiece feeding direction: the term "length" of an element is also taken in the travelling direction, a "width" being perpendicular to the traveling direction and in the horizontal plane.

There are two possible implementations of the lower conveyors. In one implementation, a conveyor width one or a plurality of belts extends in the workpiece travelling direction and passes along an upper path around end rollers, returning to the end around pulleys along a lower. return path, ore of the pulleys, for example, being motorized. In the other implementation a conveyor consists of a series of parallel rollers transverse to the traveling direction of the workpieces and disposed one after another, these rollers each being driven at one of their common ends by a single drive belt.

There are two possible implementations of the pressure means. In one implementation, a belt conveyor passes under pressure rollers. In the other implementation a series of pressure rollers are arranged one after another in the travelling direction of the workpieces.

In addition, the invention takes advantage of the convex shape of the half-cylindrical front periphery of the last front wheel or roller of the first lower rear conveyor, and by means of a deflection means, imparts a bend to a plate-like workpiece, whose inherent rigidly normally keeps it on its normal path, passing by the first side of the sorting means then onto the second lower front conveyor. This bend makes the workpiece on the other hand, take a second path called the ejection path. The second path is immediately confirmed by the second slanted side of the sorting means.

More particularly, this sorting method is made more effective, since at least one of its components, i.e. the front wheel or roller of the first conveyor, is driven in rotation and consequently serves to force the forward motion of the plate-like workpiece both in the normal path or the ejection path.

Advantageously, the deflection means can include one or a plurality of deflection shoes, their total width substantially corresponding to the width of the front edge of the plate-like workpiece. Th(e lower deflection surface of each deflection shoe is slanted or concave corresponding to the front periphery of the lower front wheel or roller, for example arc shaped with an angle varying from 5 to 90 degrees.

This deflection means of particularly simple construction, proves to be particularly effective in imparting a bend to the workpieces, in combination with the front wheel or roller of the rear conveyor, and can easily be rapidly operated.

Advantageously, the deflection means can be the lower rear surface of a deflection wheel or roller, prefer-ably a wheel or roller driven in rotation. More particularly, implementation of the deflection means is a band or a belt passing under the lower rear periphery of the front end wheel or roller of the front end of the upper rear belt conveyor, opposite the lower rear conveyor, or belonging to the front end of a rear part of the upper belt conveyor.

This deflection means is also particularly effective because it also applies, besides the deflection, a complementary forward driving force to the plate-like workpiece. Preferably, the deflection means is a combination of a band or belt passing under the roller by which the belt is driven, and two deflection shoes on either side of the roller, ensuring the bending of the whole width of the front edge of the plate-like workpiece.

Preferibly, an ejection conveyor beginning with a pair of motorized rollers mounted facing one another is situated below the slanted side of the sorting means, if desired, the roller or the two rollers being the input of a belt conveyor to handle the ejected workpiece.

This ejection conveyor, situated immediately after the sorting means, avoids the risk of jamming the deflected plate-like workpieces, by intentionally driving these workpieces at a higher speed thin the speed of the workpieces in the normal path.

Preferatly, the distance between the pair of wheels or rollers defining the end of the first lower rear conveyor and either the pair of wheels or rollers defining the beginning of the second lower front conveyor or the pair of wheels or rollers defining the beginning of the ejection conveyor is less than the smallest length of workpiece to be handled.

The plate-like workpieces are then always controlled by drive means, thus forcing these workpieces to move forward in one direction or in the other.

Preferably, the deflection means are mounted on the substantially horizontal short arm of a lever, the other end of the long arm of which is upwardly oriented. The long arm is moved by an actuator such that deflection means are moved between their raised and lowered position in a direction perpendicular to the normal path of the plate-like workpieces.

This lever constitutes a mechanical amplifier permitting imparting a short movement to the deflection means between the normal raised position and the lowered deflection position but with strong actuating force, and this by means of an actuator exerting only a weak force, the stroke of the control rod of which can be greater. Through this arrangement, it is possible to use a less expensive but very rapidly acting cylinder.

Preferably, the second lower front conveyor is mounted on frame that is forwardly tiltable in order to facilitate access to the sorting means, to the deflection means, and to the ejection conveyor, for the purpose of maintenance and repair.

BRIEF DESCRIPTION OF THE DRAWINGS

The invention will be better understood by the study of an embodiment taken by way of nonlimiting example and illustrated by the following drawings.

In all these drawings, the identical elements or parts have a same reference numeral.

DETAILED DESCRIPTION OF THE INVENTION

Figure 1:
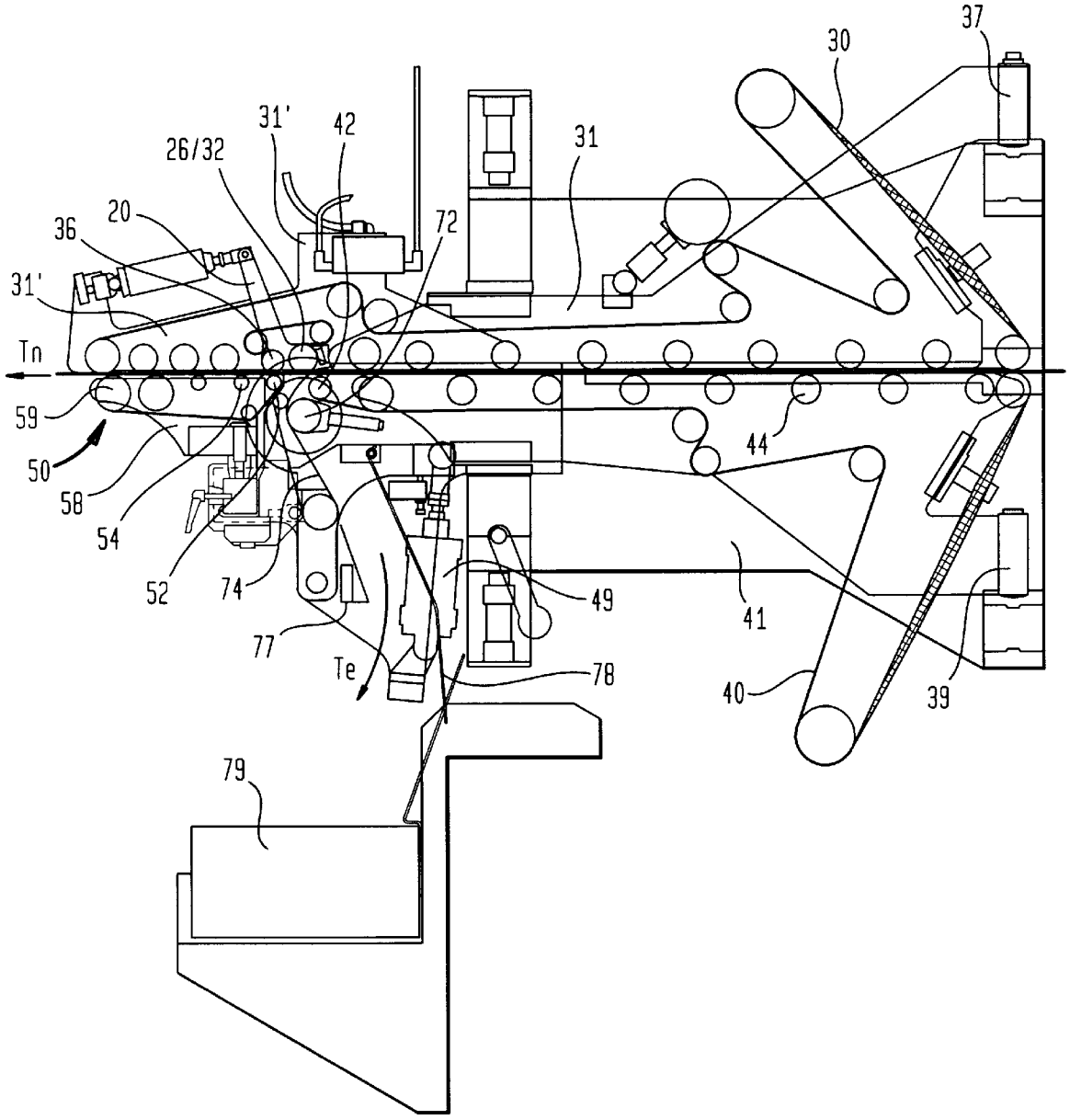
FIG. 1 is a schematic side view of a conveyor including a sorting device of the invention.

An entire belt conveyor of sorting station is illustrated in FIG. 1. Such a station is provided to separate a plurality of printed blanks that are die-cut in a sheet of cardboard side by side broadwise, and according to a plurality of successive lines in the longitudinal direction by different rotary or platen die-cutting and printing stations that are located in the upstream direction, i.e. to the right of FIG. 1. This sorting device comprises a plurality of belt conveyors arranged fan-shaped side by side so as to separate the blanks laterally, each of these conveyors having a forward speed that is higher than the speed of the previous station, in order to also separate the blanks in the longitudinal direction.

Figure 2:
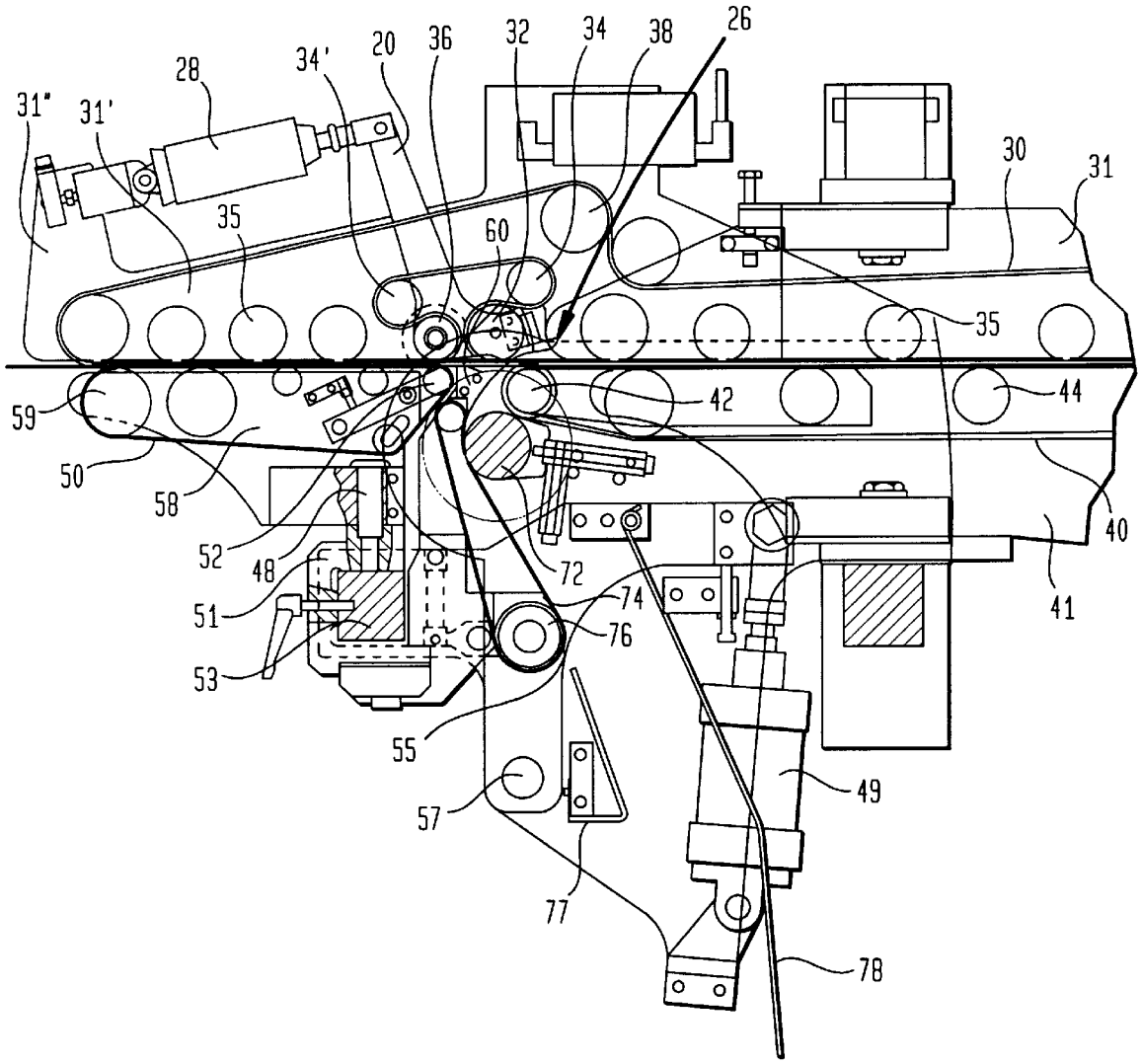
FIG. 2 is a schematic side view of the sorting section of the conveyor to FIG. 1.

Each of these belt conveyors leads the blanks according to a substantially horizontal path Tn toward a corresponding blank piling station located to the left of FIG. 1. Each conveyor includes a sorting device 26, 32, 42, 60 better shown in FIG. 2, illustrating in enlarged manner the front part of this conveyor. The sorting device allows removal of blanks of inadequate quality along an ejection path Te toward a salvage container 79. To accomplish this, each blank individually travels under a scanning area comprising, for example, a camera and/or scanning cells detecting printing errors, for example, color registration, glue tracks, stains, or even inaccurate folding. This scanning area is connected to electronic and/or data processing means that control the actuation of the sorting device as soon as the passage of the rear edge of the last accurate blank has been detected by another photocell located near the rear of the sorting device.

As better seen in FIG. 1, this belt conveyor comprises, first, a first lower belt conveyor 40 following an upper horizontal path passing over a plurality of supporting rollers 44 up to a last front roller 42. This belt 40 returns to a lower path where it passes through a tightening mechanism and a lower drive shaft before being twisted then returned to its upper horizontal path. The guiding and supporting rollers 42, 44 of this conveyor 40 are mounted on a lower vertical supporting plate 41 pivotally mounted at its rear edge on a hinge 39 which is fixed to the frame of the sorting station.

In addition to the sorting device, the conveyor comprises a second lower front conveyor 50, the belt of which starts its upper horizontal path by passing around a first rear roller 52, continues it by passing over supporting rollers 54, said belt being returned to its lower return path around its front end roller 59. In addition, these supporting and guiding rollers 52, 54, 59 of the belt 50 are mounted on a vertical supporting plate 58 adapted to be tilted forward for the purpose of providing access to the sorting device, if necessary.

As better seen in FIG. 2, for this purpose the plate 58 is mounted through pivot 48 to a stirrup 51, the position of which is adjustable along a cross beam 53 of the sorting station. The beam 53 is carried on both sides of the frame of the station by two lateral T-shaped tilting plates 55, one right, and one left, pivoting respectively around their pivot 57. On both sides of the station, the T-shaped plate 55 is tiltable by a hydraulic or pneumatic cylinder 49 acting between a fixed point of the frame and the plate's rear arm. Thus, the position and orientation of each of the vertical supporting plates 58 of the lower front conveyor 50 can be adjusted in order to be aligned with the lower vertical supporting plate 41 of the first lower conveyor 40.

More particularly, according to the invention and as illustrated in FIGS. 1 and 2, this conveyor includes a single upper conveyor 30 following a lower substantially horizontal path passing under support rollers 35, and this path corresponding to the upper path of the lower conveyor. This upper conveyor is returned along an upper return path guided by rollers 38 where it passes around different tightening devices and an upper rear drive shaft before returning to the lower drive path.

More particularly, and as better shown in FIG. 2, the lower path of this belt 30 describes an upwardly oriented loop at the level of the sorting device 60 by being successively guided by the front end roller 32 of the rear part of the upper conveyor, by two upper rollers 34, 34', then returned by area end roller 36 of the second front part of the upper conveyor. This deflection loop is approximately T-shaped, i.e. the belt 30, on the one hand, rolls up at least on the front half of the surface of the roller 32, the roller 34 being situated to the rear with respect to this roller 32; and on the other side, rolls up at least on the rear half of the surface of the roller 36, the roller 34' being situated in front of roller 36.

All the support rollers 35 of the lower path, the guiding rollers 38 of the upper return path as well as the two loop rollers 34, 34' are mounted on a vertical supporting plate in two parts 31 and 31' fixed to one another and mounted by a hinge 37 to the frame of the sorting station so as to align with, the supporting plate 41. On the other hand, the front parts are both mounted on a lever 20 of the sorting device.

Figure 3:
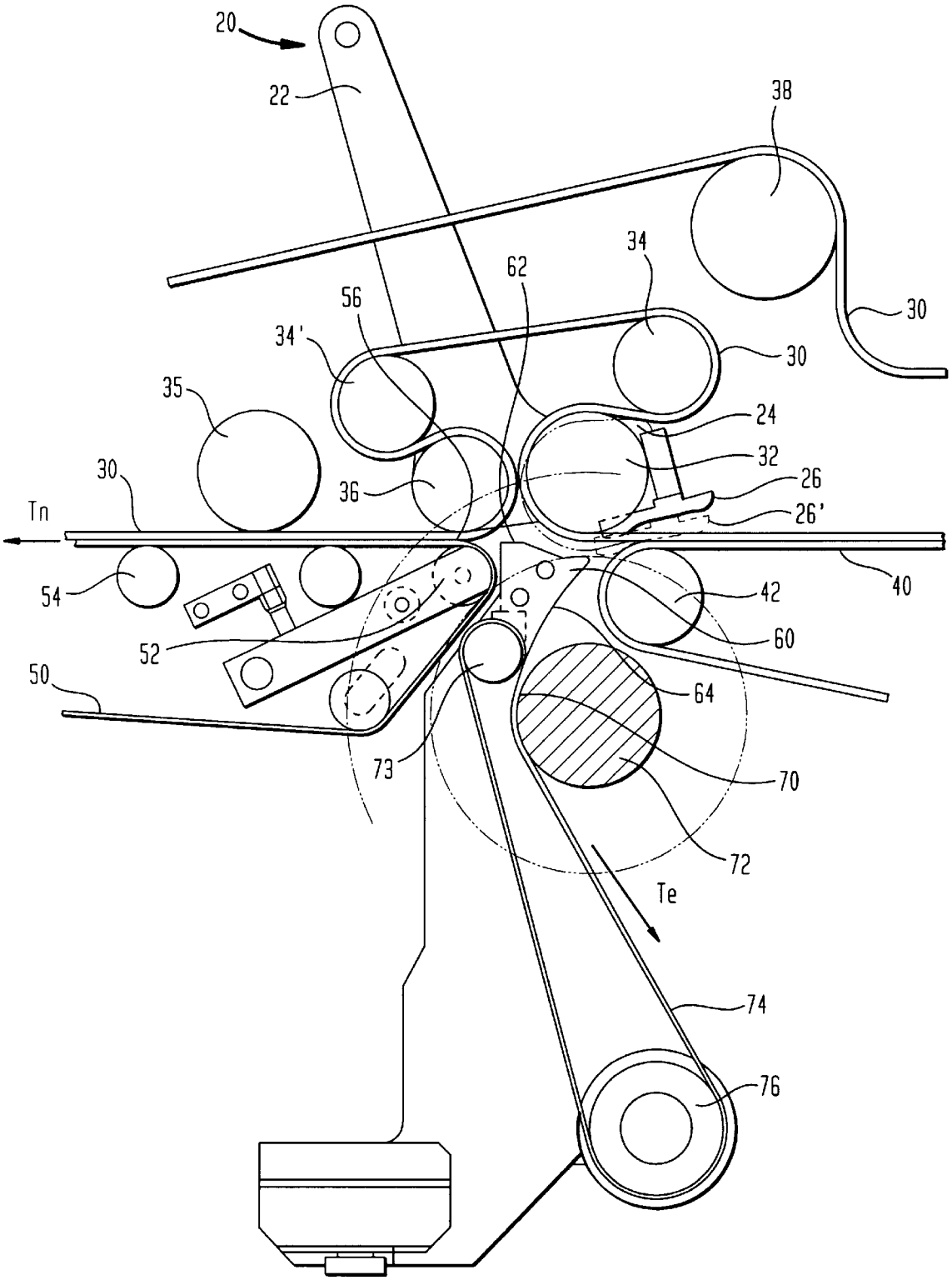
FIG. 3 is schematic view in enlarge scale of the sorting device FIGS. 1 and 2.

As better visualized in FIGS. 2 and 3, the sorting device according to the invention comprises, first, a sorting corner 60 situated under the normal path Tn, between the front end roller 42 of the lower rear conveyor 40 and the rear end roller 52 of the lower front conveyor 50. This sorting corner is a machined piece having an angled cross section facing the rear (upstream direction) of the device. The upper surface 62 of this machined piece makes up the first side of the corner provided to support the normal path Tn, and is formed of a rear horizontal plane, followed by a slanted raising intermediate plane and ending in third front plane, also horizontal. The lower rear surface 64 makes up the second side of the corner provided to guide the ejection path Te, and consists of a plane slated upwardly at an angle of about 60 degrees with respect to the horizontal plane.

The machined piece is bolted to two lateral plates, the slanted rear edges of which extend the second slanted deflection side 64. A first roller 73 of an ejection belt 74 is situated underneath the machined piece, between the lateral plates, passing around a lower pulley 76 movable under the action of an elastic device (not shown) for tightening this belt. A powerful motorized roller 72 is provided at the level of this upper roller 73 of the belt 74, running at peripheral speed that is higher than the speed of the conveyors so as to very rapidly eject the defective workpieces.

The nip 70 of the ejection drive between the rollers 72 and 73 is located at a short distance from the upper surface of the front end roller 42 of the lower conveyor 40, this distance being less than 80 mm more than the minimum length of the blanks to be processed by the sorting station. It should be noted, that the distance between the nip 56 of the front conveyor on the normal path Tn, made up by the two upper 36 and lower rollers 52 is also located at a short distance, for example about 80 mm from the upper surface of the roller 42, where the blank is released by the rear conveyors.

As better seen in FIGS. 1 and 2, the ejection belt 74 guides the ejected blanks in a chute formed by the guiding rails 77 and 78 leading the ejected blanks into the salvage container 79.

Figure 4:
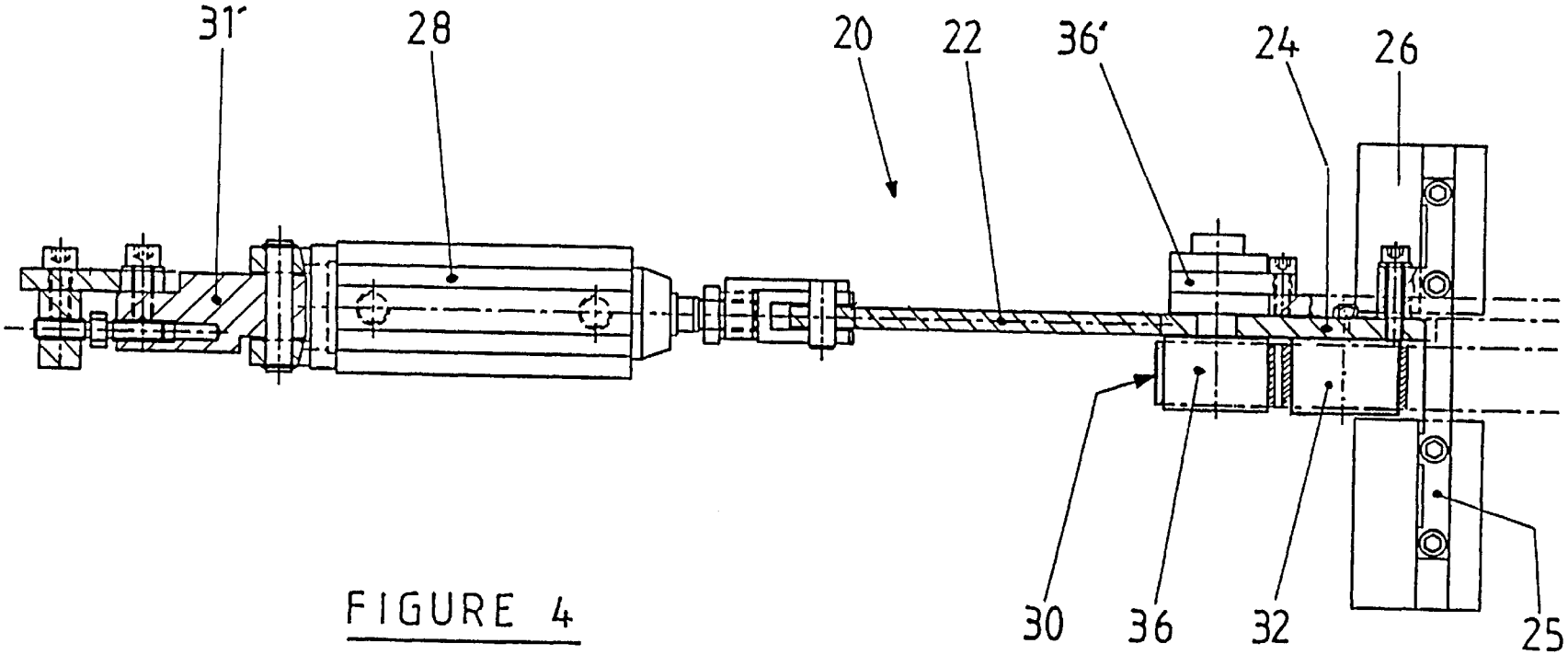
FIG. 4 is a schematic top view of the sorting device of the preceding drawings.

In addition, the sorting device includes a lever 20, better visualized in FIGS. 3 and 4. This lever comprises, on the one hand, a short arm 24, which is substantially horizontal and arranged slightly above the sorting corner 60 and the roller 42, and, on the other hand, a vertical long arm 22, which is substantially slanted forward. This lever 20 pivots around an axle supported by a bearing 36' of the upper supporting plate 31', this axle also carrying the rear end roller 36 of the front part of the upper conveyor 30.

As better seen in FIGS. 3 and 4, the short arm 24 carries, approximately at its middle, the front end roller 32 of the rear part of the conveyor 30 and at its rear end, a vertical connecting strap 25, supporting two deflection shoes 26 on both sides of the roller 32. These shoes have the shape of plates, slightly slanted with respect to the horizontal plane, and extend substantially across the expected width of the blanks. It should be observed that the roller 32 is supported on the short arm 24 in such a manner that its rear half is at the same level as the front half of the end roller 42. In similar manner, the front half of the shoes 26 are also located level with the front half roller 42, said front half having a lower surface which is arc-shaped in downward direction, for example, half-cylindrical with an angle varying from 10° to 30°.

As illustrated in FIG. 3, the lever 20 can take two positions. In the first position, the short arm 24 is raised, such that the belt 30, guided by the roller 32 and the shoe 26 does not interfere with the normal path in of the blanks. In the second position, marked with reference 26', the short arm 24 is lowered, such that the rear parts of the shoes 26 and the belt 30, guided by the roller 32, surround a part of the upper front surface of the end roller 42 so as to force the blanks to bend downward. This bend is such that the front edge of the blank is forced to pass under the slanted deflection side 64 of the sorting corner 60. In other words, the front end of the roller 42 of the rear conveyor 40 becomes a deflection roller by which a blank is bent forward and downward under the deflecting action jointly imposed by the shoes 26 and the belt 30 passing under the lowered deflection roller 42 on the one hand, and the combination of the shoes 26 and the upper front end and deflection roller 32 on the other hand, is reinforced as the lower 40 and upper belts 30 force the forward motion of the blank. The deflection roller 42 or the shoes 26 could separately act to deflect the workpieces toward the ejection path.

More particularly, the movement of the deflection shoes/rollers between the non-interfering position 26 and the lower deflection position 26' is more easily imposed as the other arm of the lever 22 is lengthened. This long arm of lever 22 is controlled by the end of the actuating rod of the pneumatic cylinder 28, the rear of the body of which is supported by a vertical extension 31" located at the end of the upper vertical supporting plate 31'. The tilting of the sorting device in one direction then in the other can thus be particularly rapid, allowing it to operate at high conveyor speeds, for example of about 500 meters per minute.

In particular, it will be noted that the only elements that must move are the cylinder rod 38, the lever 20, the deflection roller 32 with its belt part 30, and the shoes 26. This assembly has a mass that possesses distinctly less inertia than the whole part of the lower conveyor as used in prior art devices.

Furthermore, it should be observed that the length of the path formed by the belt 30 passing around the deflection roller 32 is almost unchanged between the raised position and the lowered position of the roller in the configuration of this sorting device, such that it is not necessary to provide supplementary means for following variations of the length of the path of this belt 30. Moreover, due to the upward arrangement of said deflection loop by means of rollers 34 and 34', a common belt can be used for the rear and front part of the upper conveyor surrounding the sorting device. This upper conveyor thus remains easy to adjust and to operate.

As may Save been gathered from the reading of this description, the sorting device of the invention can be integrated into a narrow conveyor, but could be adapted without difficulty to a sorting device for a wider conveyor by replacing the initial shoes with wider shoes or a series of shoes extending across the width of the workpieces to be sorted. Alternatively, a plurality of conveyors side by side with their associated deflection devices can be provided, which would then be simultaneously actuated. The words "wheel" and "roller" are generally synonymous, with "wheel" indicating a relatively narrower article and "roller" indicating a relatively wider article.

Numerous improvements can be added to this sorting device within the scope of the claims.

What is claimed is:

1. A sorting device in a transport system for sorting workpieces having a minimum length, between a normal path and an ejection path, comprising in combination:

a) a lower rear first conveyor belt (40) ending in a front roller (42) driven in rotation;

b) a lower front second conveyor belt (50) downstream of the first conveyor belt (40) and beginning with a rear roller (52) driven in rotation;

c) a means (30, 35) for pressing the plate-like workpieces against the first conveyor belt (40) and the second conveyor belt (50);

d) a sorting means (60) interposed between the front roller (42) of the first conveyor belt (40) and the rear roller (52) of the second conveyor belt (50), the sorting means having, in cross section, a corner facing the upstream end of the conveyor with a first side (62) oriented parallel to the normal path (Tn), and situated just below the normal path and a slanted second side (64) oriented parallel to the ejection path (Te), the ejection path passing between the first conveyor belt (40) and second conveyor belt (50);

e) a deflection means (26, 32) situated above and downstream of the front roller (42) of the first conveyor belt (40), which deflection means, in raised position does not interfere with the normal path (Tn) of the workpieces along the first side (62) of the sorting means (60), and which, in lowered position forces the workpieces into the ejection path (Te) bent against the front surface of the front roller's downstream side such that the workpiece follows the ejection path under the slanted second side (64) of the sorting means (60); and f) an ejection conveyor (74), beginning with a pair of motorized rollers (72, 73) situated facing one another, situated below the slanted second side (64) of the sorting means (60) and adapted to drive the workpieces along the ejection path at a higher speed than the speed of the workpieces along the normal path.

2. A sorting device of claim 1 in which the deflection means comprises at least one deflection shoe (26), the width of the at least one deflection shoe extending substantially across the width of the front edge of the plate-like workpieces.

3. A sorting device of claim 1 in which the deflection means comprise a combination of a third conveyor belt (30) passing under an upper front end roller (32) and deflection shoes (26) situated on either side of the upper front end roller (32).

4. A sorting device of claim 1 which the pair of motorized rollers (72, 73) is situated at the upper end of an ejection conveyor (74).

5. A sorting device of claim 1, in which the distance between the front roller (42) defining the end of the lower rear first conveyor belt (40) and the rear roller (52) defining the beginning of the lower front second conveyor belt (50), and the distance between the front roller (42) and the pair of motorized rollers ( 72, 73) defining the beginning of an ejection conveyor (74), are smaller than the minimum length of the workpieces to be sorted.

6. A sorting device of claim 1 in which the lower front second conveyor belt (50) is mounted on a frame (58) that is tiltable in the direction of forward motion of the workpieces.

7. A sorting device of claim 1, in which the lower front second conveyor belt (50) is mounted so as to be freely rotatable around a pivot (48) so as to be automatically aligned with the pressure means (30), with respect to the angle around the pivot (48).

8. A sorting device in a transport system for sorting workpieces having a minimum length, between a normal path and an ejection path, comprising in combination:

a) a lower rear first conveyor belt (40) ending in a front roller (42) driven in rotation;

b) a lower front second conveyor belt (50) downstream of the first conveyor belt (40) and beginning with a rear roller (52) driven in rotation;

c) a means (30, 35) for pressing the plate-like workpieces against the first conveyor belt (40) and the second conveyor belt (50);

d) a sorting means (60) interposed between the front roller (42) of the first conveyor belt (40) and the rear roller (52) of the second conveyor belt (50), the sorting means having, in cross section, a corner facing the upstream end of the conveyor with a first side (62) oriented parallel to the normal path (Tn), and situated just below the normal path and a slanted second side (64) oriented parallel to the ejection path (Te), the ejection path passing between the first conveyor belt (40) and second conveyor belt (50); and e) a deflection means (26, 32) situated above and downstream of the front roller (42) of the first conveyor belt (40), which deflection means, in raised position does not interfere with the normal path (Tn) of the workpieces along the first side (62) of the sorting means (60) and which, in lowered position forces the workpieces into the ejection path (Te) bent against the front surface of the front roller (42) roller's downstream side such that the workpiece follows the ejection path under the slanted second side (64) of the sorting means (60), wherein the means for pressing the workpieces against the lower conveyor comprises an upper rear conveyor situated opposite the lower rear first conveyor belt (40) terminating at its downstream end in an upper front end roller (32), and wherein the deflection means comprises a third conveyor belt (30) passing under the front end roller (32).

9. A sorting device in a transport system for sorting workpieces having a minimum length, between a normal path and an ejection path, comprising in combination:

a) a lower rear first conveyor belt (40) ending in a front roller (42) driven in rotation;

b) a lower front second conveyor belt (50) downstream of the first conveyor belt (40) and beginning with a rear roller (52) driven in rotation;

c) a means (30, 35) for pressing the plate-like workpieces against the first conveyor belt (40) and the second conveyor belt (50);

d) a sorting means (60) interposed between the front roller (42) of the first conveyor belt (40) and the rear roller (52) of the second conveyor belt (50), the sorting means having, in cross section, a corner facing the upstream end of the conveyor with a first side (62) oriented parallel to the normal path (Tn) and situated just below the normal path and a slanted second side (64) oriented parallel to the ejection path (Te), the ejection path passing between the first second conveyor belt (40) and conveyor belt (50); and e) a deflection means (26, 32) situated above and downstream of the front roller (42) of the first conveyor belt (40), which deflection means, in raised position does not interfere with the normal path (Tn) of the workpieces along the first side (62) of the sorting means (60) and which, in lowered position forces the workpieces into the ejection path (Te) bent against the front surface of the front roller (42) roller's downstream side such that the workpiece follows the ejection path under the slanted second side (64) of the sorting means (60) wherein the deflection means are mounted on a lever (20) having a substantially horizontal short arm (34) and an upwardly oriented end of a long arm (22), the long arm (22) of which is adapted to be moved by an actuator (28), such that the deflection means are moved between a raised position and a lowered position in a direction perpendicular to the normal path (Tn) of the plate-like workpieces.

* * * * *